US005318285A

United States Patent [19]

Edwards et al.

[11] Patent Number: 5,318,285

[45] Date of Patent: Jun. 7, 1994

[54] ROLLER/GUIDE PLATE ASSEMBLY FOR NINETY DEGREE DOCUMENT TRANSFER UNIT

[75] Inventors: Robert J. Edwards, Ridgefield; Thomas M. Helit, Bethel; Richard F. Stengl, Wolcott, all of Conn.

[73] Assignee: Pitney Bowes Inc., Stamford, Conn.

[21] Appl. No.: 980,940

[22] Filed: Nov. 23, 1992

[51] Int. Cl.[5] ..... B65H 5/00

[52] U.S. Cl. ..... 271/225; 271/272; 271/184

[58] Field of Search ..... 198/457; 271/184, 225, 271/272, 273, 274

[56] References Cited

U.S. PATENT DOCUMENTS

| | | | |
|---|---|---|---|
| 3,195,887 | 7/1965 | Bean . | |
| 3,661,383 | 5/1972 | Morrison | 271/273 |
| 4,482,148 | 11/1984 | Stewart, Jr. | 271/273 |
| 4,527,792 | 7/1985 | Burkhardt | 271/184 |
| 4,540,458 | 9/1985 | Baughman et al. | 271/225 |
| 4,553,672 | 11/1985 | Salvagnini | 271/225 |
| 4,570,923 | 2/1986 | Hooper et al. | 271/273 |
| 5,137,270 | 8/1992 | Sloan et al. | 271/273 |
| 5,180,154 | 1/1993 | Malick | 271/225 |
| 5,180,159 | 1/1993 | Malick | 271/184 |
| 5,188,355 | 2/1993 | Lowell et al. | 271/225 |

FOREIGN PATENT DOCUMENTS

| | | | |
|---|---|---|---|
| 26635 | 2/1991 | Japan | 271/225 |

*Primary Examiner*—David H. Bollinger
*Attorney, Agent, or Firm*—Charles R. Malandra, Jr.; Melvin J. Scolnick

[57] ABSTRACT

An improvement for an apparatus conveying sheets of paper seriatim along a deck between a plurality of roller pairs, including lower driven rollers and corresponding upper biased idler rollers. The improvement comprises a roller and guide plate assembly pivotably mounted on the deck. The roller and guide plate assembly includes a guide plate operatively coupled to rigid support shafts and upper roller assemblies of the roller pairs, and means for supporting the guide plate a fixed distance above the deck. The guide plate is mounted to at least two shaft support blocks, the rigid support shafts for the upper roller assemblies being mounted to the support blocks above the guide plate, the guide plate including slots through which the biased upper rollers of the upper roller assemblies extend therethrough to cooperate with the corresponding lower driven rollers to convey sheets across the deck. One of the shaft support blocks is pivotably mounted to the deck whereby the roller and guide plate assembly is pivotable between a raised position and a lowered operating position. There is a locking mechanism, including a support bracket and means for locking the roller and guide plate assembly to the support bracket in the lowered operating position, the roller and guide plate assembly being supported by a lower leg of the support bracket when the roller and guide plate assembly is in a lowered operating position.

9 Claims, 4 Drawing Sheets

300
306
308
310
314
316
320
322
326
d
208
210
214
216
218
220
222
224
226
230
232
234
244
3
3

ROLLER/GUIDE PLATE ASSEMBLY FOR NINETY DEGREE DOCUMENT TRANSFER UNIT

FIELD OF THE INVENTION

The present invention relates to document inserting machines which assemble batches of documents for insertion into envelopes, and more particularly, to inserting machines including a change in the orientation of the document conveyed along a transport.

BACKGROUND OF THE INVENTION

Multi-station document inserting machines generally include a plurality of various stations which are configured for specific applications. Typically, such inserting machines, also known as console inserting machines, are manufactured to perform operations customized for a particular customer. Such machines are known in the art and are generally used by organizations which make up large volume mailings where the content of each mail piece may vary.

An example of a document inserting machine is disclosed in U.S. Pat. No. 4,547,856 issued to Piotroski, et al. on Oct. 15, 1985 and assigned to the assignee of the present invention. This inserting machine includes a plurality of serially arranged stations including an envelope feeder and insert station, a plurality of insert feeder stations and a burster-folder station. There is a computer generated forms or web feeder that feeds continuous form control documents having control coded marks printed thereon to the burster-folder station for separating and folding. The control marks on the control documents are sensed by a control scanner located in the burster-folder station. Thereafter, the serially arranged insert feeder stations sequentially feed the necessary documents onto a transport deck at each station as the control document arrives at the respective station to form a precisely collated stack of documents which is transported to the envelope feeder-insert station where the stack is inserted into the envelope.

Generally, control documents are fed in a predetermined orientation, i.e., landscape or portrait, that facilitates a fixed beam scanner reading control marks on the moving documents. In certain applications, after the control marks are read, it is necessary to convey the documents in the other orientation for further processing, such as insertion into an envelope. One conventional way for achieving landscape to portrait, or portrait to landscape change in orientation of sheets as they are conveyed through an inserting machine includes a first paper path conveying to a distinct second paper path. The first paper path, conveying in a first direction, ends at a second paper path which is typically orthogonal to the first paper path and conveying in a second direction. Generally, the conveying means of the second paper path does not begin to convey until the sheet has been transferred from the first paper path to the second paper path. Such an arrangement ensures the proper orientation of the sheet being conveyed in the second direction but reduces the throughput of the inserting machine.

In U.S. Pat. No. 5,180,154, issued Jan. 19, 1993 and assigned to the assignee of the present invention, a right angle transfer device is disclosed. The transfer device changes the direction of travel of a flat article being conveyed at a high speed, e.g. 100 inches/second, without turning the article. The device includes a take away unit which receives the article being conveyed in a first direction, and conveys the article in a second direction, preferably 45° from the first direction, to a registration wall extending in a third direction which is orthogonal to the first direction. A third direction conveying means conveys the article for further processing. Although the right angle transfer device is suitable for changing the direction of travel of flat articles having a certain thickness or rigidity, the device has not suitable for changing the direction of single sheets being conveyed at a high speed. Specifically, the single sheets tend to crash into the registration wall at high speed resulting in a crumpling of the sheet and a subsequent paper jam.

U.S. Pat. No. 5,188,355, issued Feb. 23, 1993 and assigned to the assignee of the present invention, provides an apparatus for changing the direction of travel of sheets of paper being conveyed seriatim along a paper path without changing the orientation of the sheets with respect to a first direction of travel. The apparatus comprises a deck having an upstream end for receiving a sheet being conveyed along a paper path in a first direction. There are a plurality of first roller pairs operatively coupled to the deck and disposed in a second direction for seizing a first leading edge of the sheet and conveying the sheet in the second direction along the deck. The second direction forms an acute angle of at most 45° with the first direction. It is noted in U.S. Pat. No. 5,188,355 that conveying individual sheets at a high speed, for example, 105 inches per second, through the transfer unit to an alignment unit causes portions of a sheet to lift off of the deck unless such sheet portions are restrained. A plurality of guide fingers are operatively coupled to the first roller pairs to prevent a portion of each sheet from raising off the deck when the portion is not controlled by the first roller pairs. The alignment unit includes a plurality of second roller pairs which are operatively coupled to the deck and disposed in a third direction for seizing a second leading edge of the sheet and conveying the sheet in the third direction along the deck. The third direction forms a right angle with the first direction. The first and second roller pairs include lower driven rollers and upper biased rollers. The guide fingers include a plurality of spring structure for preventing a portion of the sheet from lifting off the deck when being conveyed at high speed. The apparatus is suitable for conveying sheets landscape to portrait or portrait to landscape.

The apparatus in U.S. Pat. No. 5,188,355, eliminated the problem associated with a registration wall in U.S. Pat. No. 5,180,154. However, another problem has been experienced relating to the spring guide fingers. The guide fingers improved the performance of the apparatus without fingers, but jams were still experienced because, notwithstanding the guide fingers, the sheets have a propensity to lift off the deck as they are conveyed at high speed through the apparatus. In particular, jams were experienced between the transfer unit and the alignment unit of the apparatus as the sheets are engaged by the second roller pairs. Thus, the number and placement of the guide fingers are directly related to the reliability of sheets being successfully fed through the apparatus. Furthermore, it was determined that the number of fingers needed and the placement thereof may differ for different sized sheets, thus requiring adjustments whenever the type of sheets being fed changed. Alternate methods, such as a brush or guide wires, are disclosed in application 816,442 for restraining the sheets from lifting off the deck.

SUMMARY OF THE INVENTION

It has been found that separate guide plates for the first roller pairs conveying in the second direction, and the second roller pairs conveying in the third direction provide an optimum guide structure that prevents any portion of the individual sheets being conveyed from rising.

In accordance with the present invention, an improvement is provided for an apparatus conveying sheets of paper seriatim along a deck between a plurality of roller pairs, including lower driven rollers and corresponding upper biased idler rollers. The improvement comprises a roller and guide plate assembly pivotably mounted on the deck. The roller and guide plate assembly includes a guide plate operatively coupled to rigid support shafts and upper roller assemblies of the roller pairs, and means for supporting the guide plate a fixed distance above the deck. The guide plate is mounted to at least two shaft support blocks, the rigid support shafts for the upper roller assemblies being mounted to the support blocks above the guide plate, the guide plate including slots through which the biased upper rollers of the upper roller assemblies extend therethrough to cooperate with the corresponding lower driven rollers to convey sheets across the deck. One of the shaft support blocks is pivotably mounted to the deck whereby the roller and guide plate assembly is pivotable between a raised position and a lowered operating position. There is a locking mechanism, including a support bracket and means for locking the roller and guide plate assembly to the support bracket in the lowered operating position, the roller and guide plate assembly being supported by a lower leg of the support bracket when the roller and guide plate assembly is in a lowered operating position.

In accordance with the present invention, an improvement is provided in an apparatus for changing the direction of travel of sheets of paper being conveyed seriatim along a paper path without changing the orientation of the sheets with respect to a first direction of travel. The apparatus comprises a transfer unit, including a deck having an upstream end for receiving each sheet being conveyed in the first direction, a plurality of first roller pairs operatively coupled to the deck and disposed in a second direction for seizing a first leading edge of the sheet and conveying the sheet in the second direction along the deck, the second direction forming an acute angle of at most 45° with the first direction; and guide means operatively coupled to the first roller pairs for preventing portions of the sheet from raising off the deck when the portions are not controlled by the first roller pairs. The apparatus also comprises an alignment unit including a plurality of second roller pairs operatively coupled to the deck and disposed in a third direction for seizing a second leading edge of the sheet and conveying the sheet in the third direction along the deck, the third direction forming a right angle with the first direction. Each of the plurality of first and second roller pairs include an upper idler roller which is part of an upper idler roller assembly mounted to one of a plurality of rigid support shafts whereby the upper idler roller is biased toward a corresponding lower driven roller.

The improvement comprises a first roller and guide plate assembly pivotably mounted on the deck of the transfer unit, said first roller and guide plate assembly including a first guide plate operatively coupled to the support shafts and upper roller assemblies of the first roller pairs, and means for supporting said first guide plate a fixed distance above the deck of the transfer unit. The first guide plate is mounted to at least two shaft support blocks, the rigid support shafts for the upper roller assemblies of the first roller pairs being mounted to said support blocks above said guide plate, said guide plate including slots through which the biased upper rollers of the upper roller assemblies extend therethrough to cooperate with corresponding lower driven rollers to convey sheets through the transfer unit, wherein one of said shaft support blocks is pivotably mounted to the deck whereby said first roller and guide plate assembly is pivotable between a raised position and a lowered operating position.

The improvement further comprises a locking mechanism, including a support bracket and means for locking said first roller and guide plate assembly to said support bracket in said lowered operating position, said first roller and guide plate assembly being supported by a lower leg of said support bracket when said first roller and guide plate assembly is in a lowered operating position.

The improvement also comprises a second roller and guide plate assembly, similar to said first roller and guide plate assembly, pivotably mounted on the deck of the alignment unit, said second roller and guide plate assembly including a second guide plate operatively coupled to the support shafts and upper roller assemblies of the second roller pairs, and means for supporting said second guide plate a fixed distance above the deck of the alignment unit.

BRIEF DESCRIPTION OF THE DRAWINGS

A complete understanding of the present invention may be obtained from the following detailed description of the preferred embodiment thereof, when taken in conjunction with the accompanying drawings wherein like reference numerals designate similar elements in the various figures, and in which.

DETAILED DESCRIPTION OF THE PREFERRED EMBODIMENT

Figure 1:
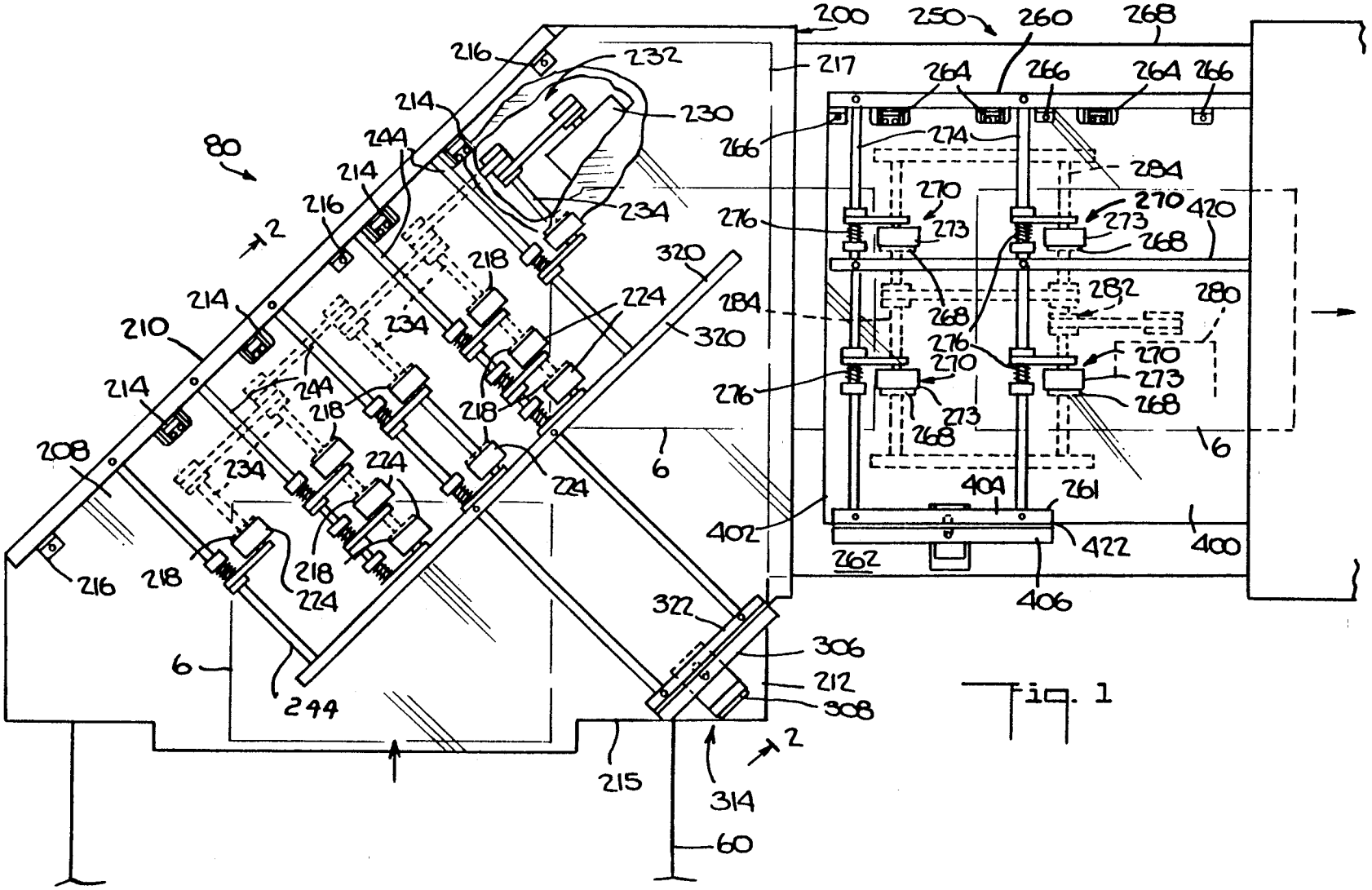
FIG. 1 is a plan view of a right angle transport assembly according to the present invention.

In describing the preferred embodiment of the present invention, reference is made to the drawings, wherein there is seen, a right angle transport assembly, generally designated 80, including a 45° transfer unit, generally designated 200, and an alignment unit, generally designated 250. Transport assembly 80 includes an improvement to the transfer assembly disclosed in U.S. patent application Ser. No. 816,442, previously noted, which is a modified version of the transfer apparatus disclosed in U.S. patent application Ser. No. 608,512, also previously noted, both of which are incorporated herein by reference.

Transfer unit 200 includes a substantially triangularly-shaped deck 212 which is supported by at least three leg members 213 (two of which are shown). Deck 212 has an input side 215 and an exit side 217. The deck includes a plurality of rectangular slots 218, through which corresponding roller pairs, generally designated 220, operate to convey sheets 6 in a 45° angle from the direction the sheets are received from an upstream transport unit 60. Each of slots 218 has protruding in part a continuously driven lower roller 222 of a corresponding roller pair 220 which cooperates with a corresponding biased upper roller 224 to convey sheets 6 across transfer unit 200. Each upper roller 224 is part of a biased upper roller assembly 226 that is mounted to one of the shafts 244. One end of each of shafts 244 is mounted to a block 210, as will be described in more detail below.

Below deck 212 is a variable speed motor 230, connected to a conventional belt and pulley drive system, generally designated 232 for driving shafts 234 on which lower driven rollers 222 are mounted. It will be understood by those skilled in the art that the orientation of the roller unit 200 is not limited to forty five degrees (45°). Any angle less than forty five degrees (45°) can be used to transport sheets 6 to alignment unit 250. When an alternate angle of deflection is employed, the length of the deck and the number of rollers may increase to complete the right angle change in direction. For a more detailed description of the drive system and roller pair structure reference is made to U.S. patent application Ser. No. 608,512, filed on Nov. 2, 1990 and assigned to the assignee of the present invention, which is incorporated herein by reference.

Figures 2, 4, 5:
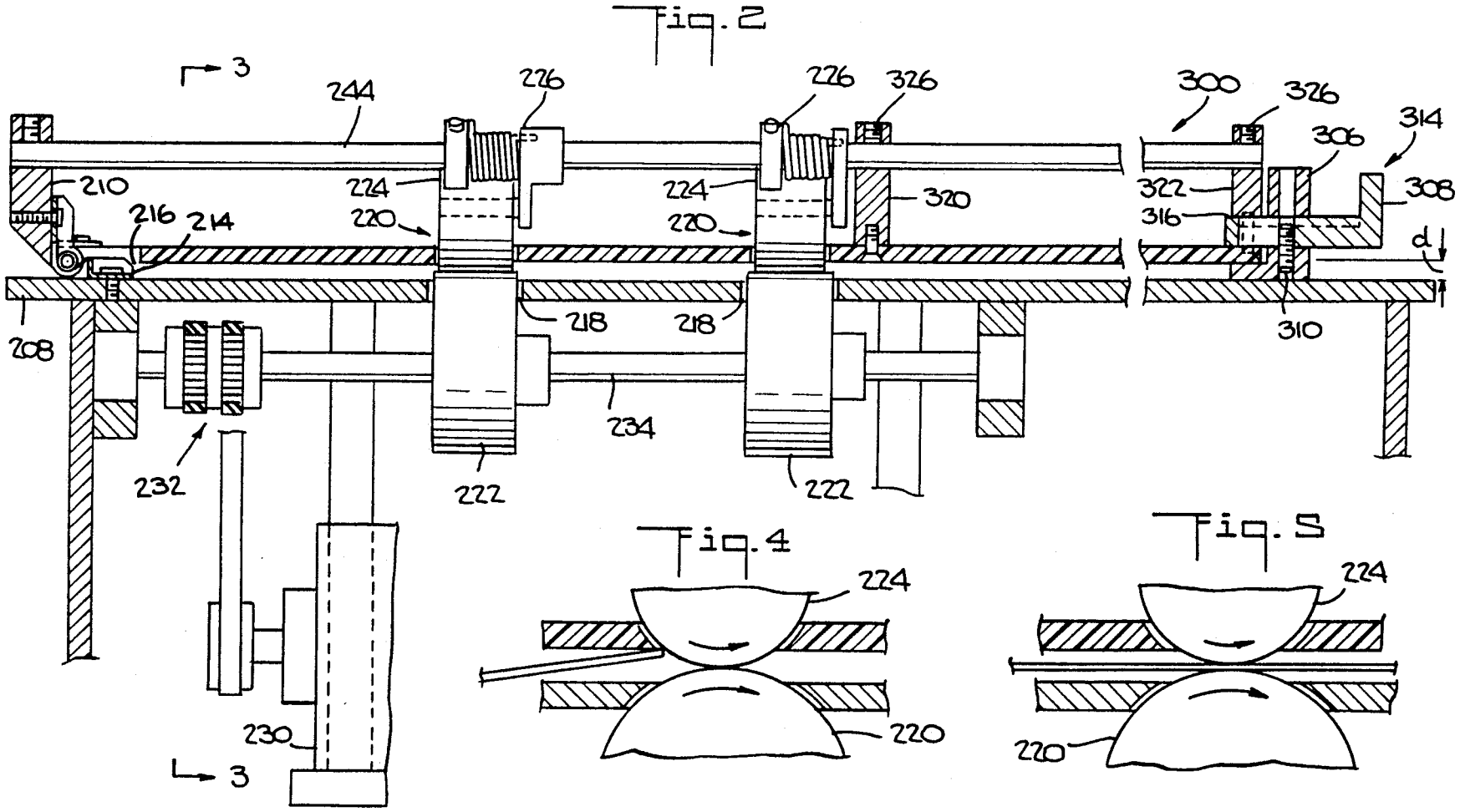
FIG. 2 is an end view of the right angle transport assembly of FIG. 1 taken along the line 2—2 in FIG. 1.
FIG. 4 is a partial side view of the right angle transport assembly of FIG. 1 showing a single sheet being transported to a roller pair in the assembly.
FIG. 5 is a partial side view similar to FIG. 4 except the document has been engaged by a roller pair.
Figure 3:
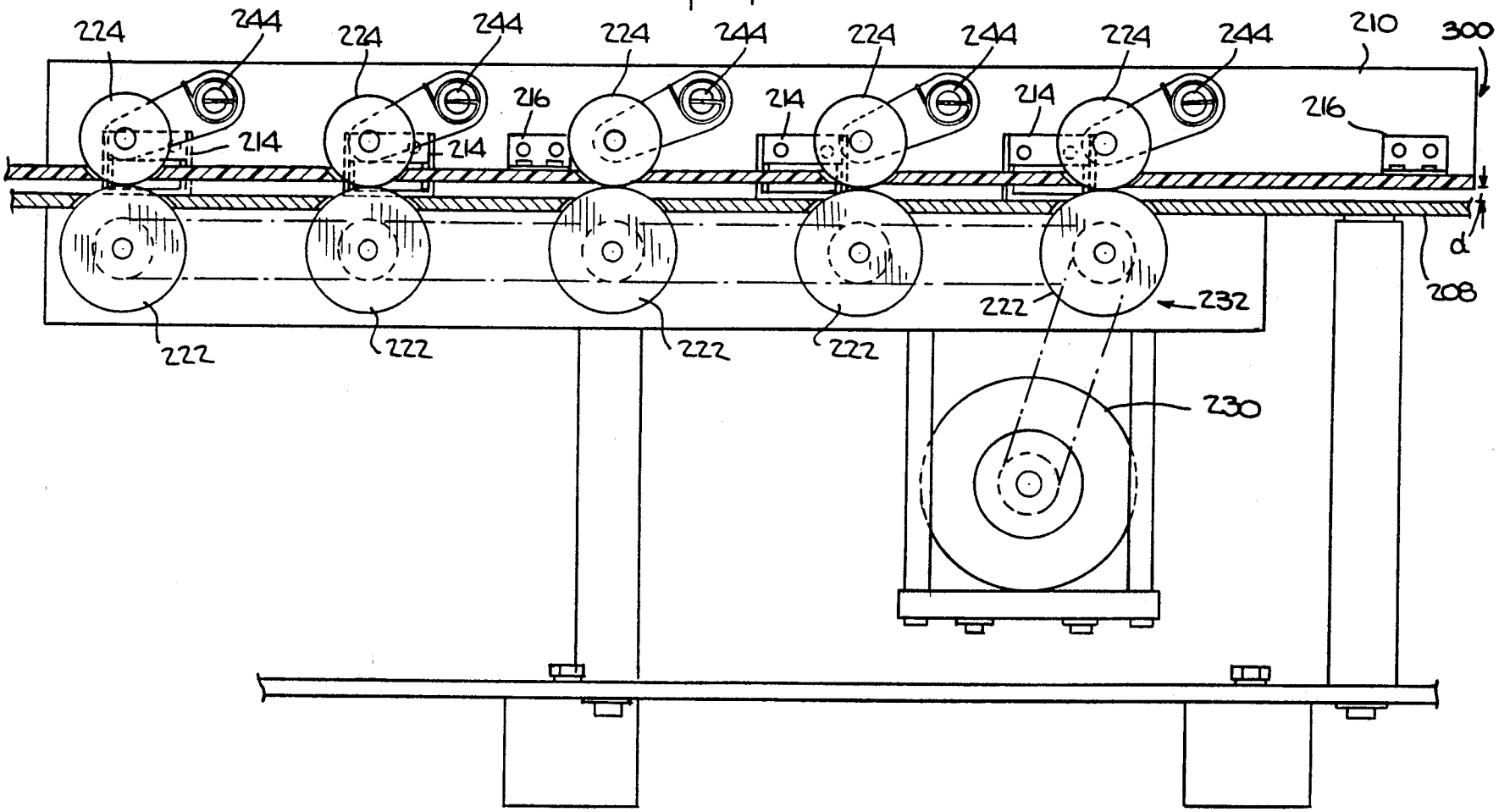
FIG. 3 is a side elevational view of the right angle transport assembly of FIG. 1 taken along the line 3—3 in FIG. 2.

In accordance with the present invention, an idler roller/guide plate assembly, generally designated 300, provides an improved guide structure for transfer unit 200. Roller/guide plate assembly 300 operates as an upper guide plate which prevents any portion of sheet 6 from rising above a predetermined height above deck 212. This substantially eliminates jams associated with the individual sheets being conveyed by roller pairs 220 at high speed. The idler roller/guide plate assembly 300 includes upper roller assemblies 226, shafts 244, block 210 and a clear plate 302. Guide plate 302, which has approximately the same dimensions as deck 212, is supported above the diagonal side 208 of deck 212 by at least three conventional brackets 216. An upper leg member of each bracket 216 is secured to block 210, and plate 302 is secured to the top side of lower leg member of bracket 216. Block 210 is pivotably secured to deck 212 by a plurality of conventional torque hinges 214. One hinge plate of each torque hinge 214 is secured, for example by screws, to block 210, and the other hinge plate is secured to deck 212 along diagonal side 208. The opposite side of plate assembly 300 is supported by a lower leg member 304 of a looking bracket 306 which is fastened to deck 212. Locking bracket 306 is located at the corner of deck 212 between input side 215 and output side 217. The thickness of leg member 304 is substantially identical to the height "d" above deck 212 that bracket 216 supports plate 302 (FIGS. 2 and 3).

Roller/guide plate assembly 300 also includes middle and end shaft supports 320 and 322, respectively. Middle shaft support 320 is situated parallel to block 210 approximately between block 210 and end shaft support 322. Middle shaft support serves a twofold purpose of supporting each of shafts 244 and maintaining plate 302 a fixed distance from shafts 244. End shaft support 322 is located at a end of plate assembly 300 opposite block 210. When plate assembly is in a lowered position, end support 322 rests on lower leg member 304 of locking bracket 306. End shaft support 322 supports two extended ones of shafts 244 and maintains plate 302 a fixed distance from shafts 244. In the preferred embodiment, supports 320 and 322 include apertures through which shafts 244 extend. Shafts 244 are suitably secured to supports 320 and 322, for example by means of screws 326. Guide plate 302 is suitably attached to the bottom of supports 320 and 322. Supports 320 and 322 are dimensioned accordingly to maintain guide plate 302 a fixed distance above deck 212 when idler roller/guide plate assembly 300 is in a lowered, operating position.

Guide plate 302 includes a plurality of slots, identical in number and corresponding location of slots 218 in deck 212. Upper rollers 224 extend through slots 318 as shown in FIGS. 2–6.

Support bracket 306 is part of a locking mechanism, generally designated 314, for roller/guide plate assembly 300. Guide plate 302 rests on leg member 304 of support bracket 306 when roller/guide plate assembly 300 is in an operating, i.e., lower, position. The support bracket 306 includes a locking tab 308 that slides back and forth through the means of a roll pin 310. Tab 308 slides through an aperture 316 in end shaft support 322.

In operation, the right angle transport assembly 80 takes sheet 6 conveyed from transport unit 60 and changes the direction of travel of sheet 6 by ninety degrees (90°) without changing the orientation of the document to a single point of reference, i.e., sheet 6 is not turned when the direction of travel changes.

Preferably, the speed of the rollers 220 is such that the linear speed of sheet 6 through the transfer unit 200 is slightly faster than the exit speed of sheet 6 from transport unit 60. The exit speed of the sheet 6 from transport unit 60 may vary from job to job and for different inserting machine. It has been found that using variable speed motor 230, the speed of the rollers 220 on transfer unit 200 can be adjusted accordingly based on any exit speed out of unit 60.

Referring now to FIG. 1, alignment unit 250 includes a block 260 pivotably secured to a deck 262. Deck 262 includes a plurality of rectangular slots 268, through which corresponding roller pairs, generally designated 270, operate to receive sheets 6 from transfer unit 200, maintain suitable alignment and convey sheet 6 downstream for further processing. Each of slots 268 has protruding in part a continuously driven lower roller (not shown) of a corresponding roller pair 270 which cooperates with a corresponding biased upper roller 273 to convey sheets 6 across alignment unit 250. Each of upper rollers 273 is part of an upper roller assembly 276 which is mounted to one of the shafts 274. Shafts 274 are rigidly mounted at one end to block 260 and at the other end to block 261. Preferably, there are four roller pairs 270. Below deck 262 is a variable speed motor 280, connected to a conventional belt and pulley drive system, generally designated 282 for driving shafts 284 on which lower driven rollers of rollers pairs 270 are mounted.

In accordance with the present invention, an idler roller/guide plate assembly, generally designated 400, which is similar to plate assembly 300, provides an improved guide structure for alignment unit 250. Roller/guide plate assembly 400 operates as an upper guide plate which prevents any portion of sheet 6 from rising above a predetermined height above deck 262. This substantially eliminates jams associated with the individual sheets being conveyed between rollers pairs 270 at high speed. The idler roller/guide plate assembly 400 includes upper roller assemblies 276, shafts 274, block 260 and a clear plate 402. Guide plate 402, which is approximately the same dimensions as deck 262, is supported above one side 288 of deck 262 by at least three conventional brackets 266. An upper leg member of each bracket 266 is secured to block 260, and plate 402 is secured to the top side of lower leg member of bracket 266. Block 260 is pivotably secured to deck 262 by a plurality of conventional torque hinges 264. One hinge plate of each torque hinge 264 is secured, for example by screws, to block 260, and the other hinge plate is secured to deck 262 along side 268. The opposite side of plate assembly 400 is supported by a lower leg member 404 of a locking bracket 406 which is fastened to deck 262. Locking bracket 406 is located at the side opposite block 260. The thickness of leg member 404 is approximately identical to the thickness of the lower leg of brackets 266.

Roller/guide plate assembly 400 also includes middle and end shaft supports 420 and 422, respectively. Middle shaft support 420 serves a twofold purpose of supporting each of shafts 274 and maintaining plate 402 a fixed distance above deck 262. End shaft support 422 is located opposite block 260. End shaft support 422 supports shafts 274 and maintains plate 402 a fixed distance above deck 262. In the preferred embodiment, supports 420 and 422 include apertures through which shafts 274 extend. Shafts 274 are suitably fixed to supports 420 and 422. Supports 420 and 422 are dimensioned accordingly to maintain guide plate 402 a fixed distance above deck 262 when idler roller/guide plate assembly 400 is in a lowered operating position.

Support bracket 406 is part of a locking mechanism, generally designated 404, for roller/guide plate assembly 400. Guide plate 402 rests on leg member 404 of support bracket 406 when roller/guide plate assembly 400 is in an operating, i.e., lower, position. The support bracket 406 includes a locking tab 408 that slides back and forth through the means of a roll pin 410. Tab 408 slides through an aperture in end shaft support 422. Thus, the gap between guide plate 402 and deck 262 is maintained.

The gap "d" between guide plate 302 and deck 212 is maintained as described above. A substantially identical gap (not shown) is maintained between plate 402 and deck 262. In the preferred embodiment of the present invention, a gap of 0.21 inches is maintained between guide plate 302 and deck 212 and between guide plate 402 and deck 262. And, clear guide plates 302 and 402 are preferably a clear, abrasion resistant material, such as Lexan, manufactured by General Electric Corporation, of Fairfield, Conn.

In the preferred embodiment of the present invention, a gap of 0.21 inches is maintained between guide plates 302 and 402 and decks 212 and 262, respectively. And, clear guide plates 302 and 402 are preferably a clear, scratch resistant material, such as Lexan.

Figure 6:
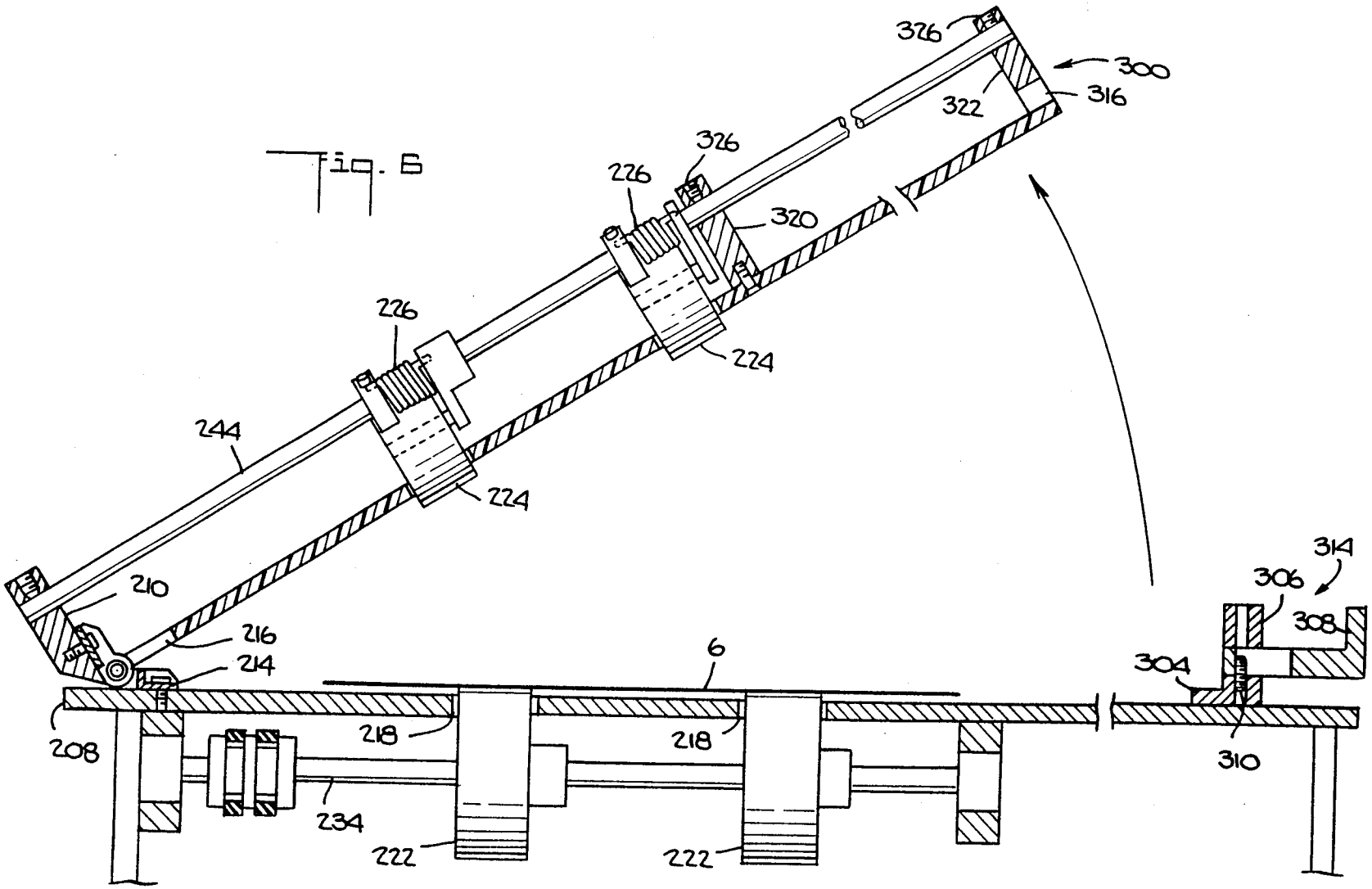
FIG. 6 is an end view of the right angle transport assembly of FIG. 1 with a top structure pivoted open.

The upstream roller pairs 270 are positioned so that sheet 6 just enters the nips of the upstream roller pairs at the instant sheet 6 is about to leave the control of the most downstream roller pairs 220 of transfer unit 200. Once sheet 6 is engaged by the upstream roller pairs 270, sheet 6 makes a second forty-five degree (45°) change in the direction of travel. As seen in FIG. 6, the orientation of sheet 6 from a single point of reference is maintained as the document travels across right angle transport 80. The speed of roller pairs 270 is slightly faster than the speed of roller pairs 220 so that there is a smooth transition as sheet 6 leaves the control of transfer unit 200 and enters the control of alignment unit 250.

Right angle transfer assembly 80 provides a constant positive drive of sheets 6, and eliminates the abrupt mechanical delay or stop previously associated with conveying landscape to portrait or portrait to landscape. It has been found that engaging sheets 6 at all times by two or more rollers provides a steady positive drive through right angle transport assembly 80 which results in better control of sheets 6 travelling at high speeds. Preferably, sheet 6 is engaged by the rollers 270 in alignment unit 250 as sheet 6 is released by rollers 220 in transfer unit 200 to provide better control for alignment at higher speeds.

In the preferred embodiment of the present invention, plate 302 includes an upstream lip 430 which overhangs the discharge structure of transport 60. and a downstream lip 432 which overhangs deck 262 to prevent sheet 6 from raising of deck 262 as sheet 6 is first entering alignment unit 250.

While the present invention has been disclosed and described with reference to a single embodiment thereof, it will be apparent, as noted above that variations and modifications may be made therein. It is, thus, intended in the following claims to plate each variation and modification that falls within the true spirit and scope of the present invention.

What is claimed is:

1. In an apparatus for changing the direction of travel of sheets of paper being conveyed seriatim along a paper path without changing the orientation of the sheets with respect to a first direction of travel, comprising a transfer unit including a deck having an upstream end for receiving each sheet being conveyed in the first direction, a plurality of first roller pairs operatively coupled to the deck and disposed in a second direction for seizing a first leading edge of the sheet and conveying the sheet in the second direction along the deck, the second direction forming an acute angle of at most 45° with the first direction; guide means operatively coupled to the first roller pairs for preventing portions of the sheet from raising off the deck when the portions are not controlled by the first roller pairs; and an alignment unit including a plurality of second roller pairs operatively coupled to the deck and disposed in a third direction for seizing a second leading edge of the sheet and conveying the sheet in the third direction along the deck, the third direction forming a right angle with the first direction, each of the plurality of first and second roller pairs including an upper idler roller which is part of an upper idler roller assembly mounted to one of a plurality of rigid support shafts whereby the upper idler roller is biased toward a corresponding lower driven roller, an improvement comprising:

a first roller and guide plate assembly pivotably mounted on the deck of the transfer unit, said first roller and guide plate assembly including a first guide plate operatively coupled to the support shafts and upper roller assemblies of the first roller pairs, and means for supporting said first guide plate a fixed distance above the deck of the transfer unit, whereby said guide plate prevents the sheets of paper from rising above a predetermined height above the deck, wherein said first guide plate is mounted to at least two shaft support blocks, the rigid support shafts for the upper roller assemblies of the first roller pairs being mounted to said support blocks above said guide plate, said guide plate including slots through which the biased upper rollers of the upper roller assemblies extend therethrough to cooperate with corresponding lower driven rollers to convey sheets through the transfer unit, wherein one of said shaft support blocks is pivotably mounted to the deck whereby said first roller and guide plate assembly is pivotal between a raised position and a lowered operating position.

2. The improvement of claim 1, further comprising a locking mechanism, including a support bracket and means for locking said first roller and guide plate assembly to said support bracket in said lowered operating position, said first roller and guide plate assembly being supported by a lower leg of said support bracket when said first roller and guide plate assembly is in said lowered operating position.

3. The improvement of claim 1, wherein said means for support include bracket means supporting said first guide plate on opposite ends of said first roller and guide plate assembly, and said shaft support blocks supporting said first guide plate said fixed distance from said rigid support shafts.

4. In an apparatus for changing the direction of travel of sheets of paper being conveyed seriatim along a paper path without changing the orientation of the sheets with respect to a first direction of travel, comprising a transfer unit including a deck having an upstream end for receiving each sheet being conveyed in the first direction, a plurality of first roller pairs operatively coupled to the deck and disposed in a second direction for seizing a first leading edge of the sheet and conveying the sheet in the second direction along the deck, the second direction forming an acute angle of at most 45° with the first direction; guide means operatively coupled to the first roller pairs for preventing portions of the sheet from raising off the deck when the portions are not controlled by the first roller pairs; and an alignment unit including a plurality of second roller pairs operatively coupled to the deck and disposed in a third direction for seizing a second leading edge of the sheet and conveying the sheet in the third direction along the deck, the third direction forming a right angle with the first direction, each of the plurality of first and second roller pairs including an upper idler roller which is part of an upper idler roller assembly mounted to one of a plurality of rigid support shafts whereby the upper idler roller is biased toward a corresponding lower driven roller, an improvement comprising:

a first roller and guide plate assembly pivotably mounted on the deck of the transfer unit, said first roller and guide plate assembly including a first guide plate operatively coupled to the support shafts and upper roller assemblies of the first roller pairs, and means for supporting said first guide plate a fixed distance above the deck of the transfer unit, whereby said guide plate prevents the sheets of paper from rising above a predetermined height above the deck; and a second roller and guide plate assembly pivotably mounted on the deck of the alignment unit, said second roller and guide plate assembly including a second guide plate operatively coupled to the support shafts and upper roller assemblies of the second roller pairs, and means for supporting said second guide plate a fixed distance above the deck of the alignment unit;

wherein said second guide plate is mounted to at least two shaft support blocks, the rigid support shafts for the upper roller assemblies of the second roller pairs being mounted to said support blocks above said guide plate, said guide plate including slots through which the biased upper rollers of the alignment unit extend therethrough and cooperate with corresponding lower driven rollers to convey sheets through the alignment unit wherein one of said shaft support blocks is pivotably mounted to the deck whereby said second roller and guide plate assembly is pivotable between a raised position and a lowered operating position.

5. The improvement of claim 4, further comprising a locking mechanism, including a support bracket and means for locking said second roller and guide plate assembly to said support bracket in said lowered operating position, said second roller and guide plate assembly being supported by a lower leg of said support bracket when said second roller and guide plate assembly is in a lowered operating position.

6. The improvement of claim 4 wherein said means for support include bracket means supporting said second guide plate on opposite ends of said second roller and guide plate assembly, and said shaft support blocks supporting said second guide plate said fixed distance form said rigid support shafts.

7. In an apparatus conveying sheets of paper seriatim along a deck between a plurality of roller pairs, including lower driven rollers and corresponding upper biased idler rollers, an improvement comprising:

a roller and guide plate assembly pivotably mounted on the deck, said roller and guide plate assembly including a guide plate operatively coupled to rigid support shafts and upper roller assemblies of the roller pairs, and means for supporting said guide plate a fixed distance above the deck, whereby said guide plate prevents the sheets of paper from rising above a predetermined height above the deck;

wherein said guide plate is mounted to at least two shaft support blocks, the rigid support shafts for the upper roller assemblies being mounted to said support blocks above said guide plate, said guide including slots through which the biased upper rollers of the upper roller assemblies extend therethrough to cooperate with the corresponding lower driven rollers to convey sheets across the deck, wherein one of said shaft support blocks is pivotably mounted to the deck whereby said roller and guide plate assembly is pivotable between raised position and a lowered operating position.

8. The improvement of claim 7, further comprising a locking mechanism, including a support bracket and means for locking said roller and guide plate assembly to said support bracket in said lowered operating position, said roller and guide plate assembly being supported by a lower leg of said support bracket when said roller and guide plate assembly is in a lowered operating position.

9. The improvement of claim 7 wherein said means for supporting include bracket means supporting said guide plate on opposite ends of said roller and guide plate assembly, and said support blocks supporting said guide plate said fixed distance from said rigid support shafts.

* * * * *